US011357366B2

(12) United States Patent
Formon et al.

(10) Patent No.: US 11,357,366 B2
(45) Date of Patent: Jun. 14, 2022

(54) WEB MATERIAL DISPENSER AND WEB MATERIAL FEED ASSEMBLY FOR A WEB MATERIAL DISPENSER

(71) Applicant: CASCADES CANADA ULC, Kingsey Falls (CA)

(72) Inventors: John Formon, Forsyth, GA (US); Jeffrey J. Brickl, Prairie Du Sac, WI (US); Matthew T. Woerpel, Lodi, WI (US); Edward A. Raleigh, Lodi, WI (US)

(73) Assignee: CASCADES CANADA ULC, Kingsey Falls (CA)

( * ) Notice: Subject to any disclaimer, the term of this patent is extended or adjusted under 35 U.S.C. 154(b) by 525 days.

(21) Appl. No.: 16/548,007

(22) Filed: Aug. 22, 2019

(65) Prior Publication Data

US 2020/0062526 A1 Feb. 27, 2020

Related U.S. Application Data

(60) Provisional application No. 62/721,282, filed on Aug. 22, 2018.

(51) Int. Cl.

| | |
|---|---|
| ***A47K 10/36*** | (2006.01) |
| ***B65H 20/02*** | (2006.01) |
| ***B65H 27/00*** | (2006.01) |

(52) U.S. Cl.

CPC ..... *A47K 10/3656* (2013.01); *B65H 20/02* (2013.01); *B65H 27/00* (2013.01); *B65H 2601/25* (2013.01)

(58) Field of Classification Search

CPC ..... A47K 10/3656; A47K 10/3612; B65H 20/02; B65H 27/00; B65H 2601/25; B65H 2404/119; B65H 2404/1316

See application file for complete search history.

(56) References Cited

U.S. PATENT DOCUMENTS

| | | | |
|---|---|---|---|
| 5,061,232 | A | 10/1991 | Bloch et al. |
| 7,380,748 | B2 | 6/2008 | Goeking et al. |
| 7,735,770 | B2 | 6/2010 | Conner |
| 9,770,143 | B2 | 9/2017 | Corley et al. |
| 2015/0157177 | A1 | 6/2015 | Carper et al. |
| 2017/0369262 | A1 | 12/2017 | Green |

*Primary Examiner* — William E Dondero

(74) *Attorney, Agent, or Firm* — Marshall, Gerstein & Borun LLP

(57) ABSTRACT

The present disclosure concerns a web material feed assembly for a web material dispenser comprising a housing, the web material feed assembly comprising first and second rollers rotatable relative to the housing of the dispenser about first and second parallel axes. The first roller is provided with friction rings forming a nip between the first and second rollers for feeding the web material therethrough, at least one of the friction rings comprising a recessed surface forming an anti-wrinkling space between the first and second rollers. The disclosure also concerns a web material dispenser with such a web material feed assembly and a method for preventing wrinkles in a web material dispensed by a web material dispenser with such a web material feed assembly.

21 Claims, 6 Drawing Sheets

WEB MATERIAL DISPENSER AND WEB MATERIAL FEED ASSEMBLY FOR A WEB MATERIAL DISPENSER

PRIOR APPLICATION

The present application claims priority from U.S. provisional patent application No. 62/721,282, filed on Aug. 22, 2018, and entitled "WEB MATERIAL DISPENSER AND WEB MATERIAL FEED ASSEMBLY FOR A WEB MATERIAL DISPENSER", the disclosure of which being hereby incorporated by reference in its entirety.

TECHNICAL FIELD

The present disclosure generally relates to a web material feed assembly for a web material dispenser. More particularly, the invention relates to a web material feed assembly that is configured to limit a wrinkling of the web material when it is dispensed. The disclosure also relates to a web material dispenser including the web material feed assembly, and to a method of feeding web material.

BACKGROUND

Several types of paper roll dispensers exist, that are configured to dispense tissue paper. Paper roll dispensers typically include, amongst others, a housing (or enclosure) defining an interior chamber and a web material feed assembly mounted to the housing and configured to make the wound tissue travel in the housing for it to be delivered via a dispenser opening formed in the housing. In some configurations, the feed assembly comprises two rollers forming a nip therebetween, for the wound tissue paper to travel through the nip before exiting the dispenser via the dispenser opening.

A free end (or tail) of the wound tissue paper usually protrudes out of the housing so that it can be grasped by a user. When a pulling force is exerted by the user on the wound tissue paper via its free end or tail, or when the web material feed assembly is driven by a motor, the wound tissue paper travels through the nip of the web material feed assembly to deliver a portion of the wound tissue paper to the user.

However, for instance when the puling force is not exerted in an adequate direction, or when the tissue paper is not properly arranged in the web material feed assembly, the tissue paper might be wrinkled during its travel through the nip. The wrinkles formed on the tissue paper might then affect or impede the dispensing of the paper.

BRIEF SUMMARY

According to a general aspect, there is provided a web material feed assembly for a web material dispenser comprising a housing. The web material feed assembly comprises a first roller rotatably mountable to the housing of the web material dispenser, about a first longitudinal axis; a second roller rotatably mountable to the housing of the web material dispenser, about a second longitudinal axis parallel to the first longitudinal axis. The first and second rollers have respective first and second lengths and face one another along at least one longitudinal segment thereof when the first and second rollers are mounted to the housing of the web material dispenser. The at least one longitudinal segment of the first roller has a strip about a circumference thereof comprising at least one guiding area and at least one anti-wrinkling area. When in use, the first roller is successively rotatable about the first longitudinal axis along: a first angular interval wherein the at least one guiding area contacts the at least one longitudinal segment of the second roller forming a nip therebetween through which a web material is fed; and a second angular interval wherein the at least one anti-wrinkling area is spaced apart from the at least one longitudinal segment of the second roller, forming an anti-wrinkling space therebetween.

According to another general aspect, there is provided a web material feed assembly for a web material dispenser comprising a housing. The web material feed assembly comprises first and second rollers rotatably mountable relative to the housing of the web material dispenser about first and second parallel longitudinal axes, the first roller being provided with at least one friction ring facing at least one longitudinal segment of the second roller and having at least one guiding surface contacting an outer surface of the at least one longitudinal segment of the second roller and forming a nip between the first and second rollers for feeding a web material therethrough when the first and second rollers are in use. The at least one friction ring comprises at least one recessed surface forming an anti-wrinkling space between the first and second rollers.

According to another general aspect, there is provided a web material dispenser configured to dispense a web material, the web material dispenser comprising: a housing; and a web material feed assembly according to the present disclosure, the first and second rollers of the web material feed assembly being rotatably mounted to the housing.

According to another general aspect, there is provided a method for preventing wrinkles in a web material dispensed by a web material dispenser having a housing, a dispenser opening being formed in the housing. The method comprises the steps of: providing first and second rollers rotatably mounted to the housing about first and second parallel longitudinal axes and forming a nip therebetween, each of the first and second rollers having an outer surface devised to contact each other at at least one longitudinal segment thereof, the outer surface of said at least one longitudinal segment of at least one of the first and second rollers comprising at least one recess forming an anti-wrinkling space between the first and second rollers; circulating a portion of the web material in the nip by squeezing the web material between the outer surfaces of the longitudinal segments of the first and second rollers; rotating at least one of the first and second rollers to drag the web material toward the dispenser opening; and allowing a portion of the web material to fully extend in the anti-wrinkling space so as to limit the wrinkling thereof.

According to another general aspect, there is provided a web material feed assembly for a web material dispenser having a housing. The web material feed assembly comprises a first roller rotatable relative to the housing of the dispenser, about a first axis; a second roller rotatable relative the housing of the dispenser, about a second axis, parallel to the first axis. The first and second rollers comprise respective peripheral outer surfaces facing one another when mounted to the housing. The peripheral outer surface of the first roller comprises at least one guiding area configured to contact the peripheral outer surface of the second roller, forming a nip therebetween in which the web material is fed; and at least one anti-wrinkling area configured to be spaced apart from the peripheral outer surface of the second roller, forming an anti-wrinkling spacing therebetween.

According to another general aspect, there is provided a web material feed assembly for a web material dispenser comprising a housing. The web material feed assembly comprises first and second rollers rotatable relative to the housing of the dispenser. The first and second rollers have respectively first and second parallel rotational axes. The first and second rollers have portions of their outer surfaces in contact and forming a nip therebetween for feeding the web material. The outer surface of at least one of the first and second rollers comprises one or more anti-wrinkling recessed areas forming one or more anti-wrinkling spacings between the first and second rollers.

According to another general aspect, there is provided a web material feed assembly for a web material dispenser comprising a housing. The web material feed assembly comprises first and second rollers rotatable relative to the housing of the dispenser. The first and second rollers have first and second parallel rotational axes and are provided with friction rings forming a nip therebetween for feeding the web material therethrough. At least one of the friction rings comprises a recessed surface forming an anti-wrinkling spacing between the first and second rollers.

According to another general aspect, there is provided a web material feed assembly for a web material dispenser having a housing and configured to dispense a web material. The web material feed assembly comprises a first roller rotatably mountable relative to the housing of the web material roll dispenser about a first axis; a second roller rotatably mountable relative to the housing of the web material roll dispenser about a second axis extending parallel to the first axis. Each of the first and second rollers comprises at least one axial portion having a peripheral outer surface. The axial portions of the first and second rollers face each other when the first and second rollers are rotatably mounted relative to the housing. The peripheral outer surface of the axial portion of the first roller comprises a guiding area configured to contact the peripheral outer surface of the axial portion of the second roller so as to define a nip therebetween in which the web material is to be fed; and an anti-wrinkling area configured to be spaced apart from the peripheral outer surface of the second roller so as to define an anti-wrinkling spacing therebetween.

According to another general aspect, there is provided a web material dispenser configured to dispense a web material. The web material dispenser comprises a housing; and a web material feed assembly comprising: a first roller rotatably mounted relative to the housing of the web material roll dispenser about a first axis; a second roller rotatably mounted relative to the housing of the web material roll dispenser about a second axis extending parallel to the first axis. Each of the first and second rollers comprises at least one axial portion having a peripheral outer surface. The axial portions of the first and second rollers face each other. The peripheral outer surface of the axial portion of the first roller comprises: a guiding area contacting the peripheral outer surface of the axial portion of the second roller so as to define a nip therebetween in which the web material is to be fed; and an anti-wrinkling area spaced apart from the peripheral outer surface of the second roller so as to define an anti-wrinkling spacing therebetween.

According to another general aspect, there is provided a method of preventing wrinkles in a web material dispensed by a web material dispenser. The method comprises the step of providing first and second rollers extending parallel to each other and forming a nip therebetween, each of the first and second rollers having an outer surface devised to contact the web material, at least one of the first and second rollers comprising one or more indents or recesses provided at its outer surface. The method further comprises the step of circulating a portion of a web material in the nip formed between the first and second rollers. Rotation of at least one of the first and second rollers pulls or drags the web material toward a dispenser opening of the dispenser.

DETAILED DESCRIPTION

Figure 1:
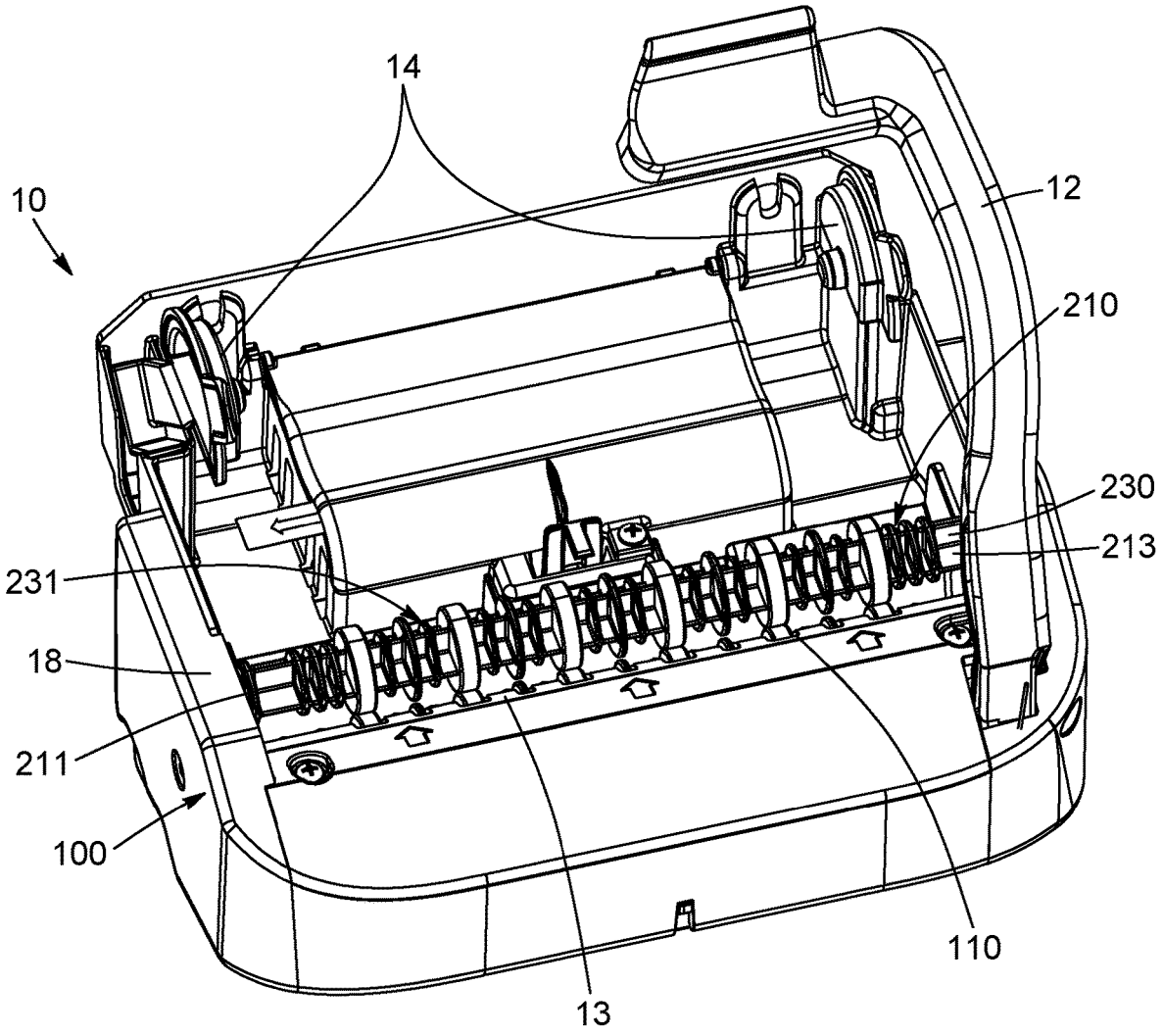
FIG. 1 is a top perspective view of a lower section of a web material dispenser comprising a web material feed assembly in accordance with an embodiment of the present disclosure.

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

Moreover, it will be appreciated that positional descriptions such as "above", "below", "forward", "rearward" "left", "right" and the like should, unless otherwise indicated, be taken in the context of the figures and correspond to the position and orientation of a web material feed assembly and corresponding parts when mounted in a web material dispenser, with the "front" corresponding to a position closer to the user and to a dispensing opening of the web material dispenser and the "rear" corresponding to a position closer to a support to which the web material dispenser is mounted. Positional descriptions should not be considered limiting.

To provide a more concise description, some of the quantitative expressions given herein may be qualified with the term "about". It is understood that whether the term "about" is used explicitly or not, every quantity given herein is meant to refer to an actual given value, and it is also meant to refer to the approximation to such given value that would reasonably be inferred based on the ordinary skill in the art, including approximations due to the experimental and/or measurement conditions for such given value.

In the following description, the term "about" means within an acceptable error range for the particular value as determined by one of ordinary skill in the art, which will depend in part on how the value is measured or determined, i.e. the limitations of the measurement system. It is commonly accepted that a 10% precision measure is acceptable and encompasses the term "about".

In the above description, an embodiment is an example or implementation. The various appearances of "one embodiment," "an embodiment" or "some embodiments" do not necessarily all refer to the same embodiments.

Although various features may be described in the context of a single embodiment, the features may also be provided separately or in any suitable combination. Conversely, although the invention may be described herein in the context of separate embodiments for clarity, it may also be implemented in a single embodiment.

Reference in the specification to "some embodiments", "an embodiment", "one embodiment" or "other embodiments" means that a particular feature, structure, or characteristic described in connection with the embodiments is included in at least some embodiments, but not necessarily all embodiments.

It is to be understood that the phraseology and terminology employed herein is not to be construed as limiting and are for descriptive purpose only.

The principles and uses of the teachings of the present disclosure may be better understood with reference to the accompanying description, figures and examples.

It is to be understood that the details set forth herein do not construe a limitation to an application of the disclosure.

Furthermore, it is to be understood that the disclosure can be carried out or practiced in various ways and that the disclosure can be implemented in embodiments other than the ones outlined in the description above.

It is to be understood that the terms "including", "comprising", and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

The descriptions, examples, methods and materials presented in the claims and the specification are not to be construed as limiting but rather as illustrative only.

Meanings of technical and scientific terms used herein are to be commonly understood as by one of ordinary skill in the art to which the invention belongs, unless otherwise defined.

The present disclosure may be implemented in the testing or practice with methods and materials equivalent or similar to those described herein.

Web Material Dispenser

Figure 2:
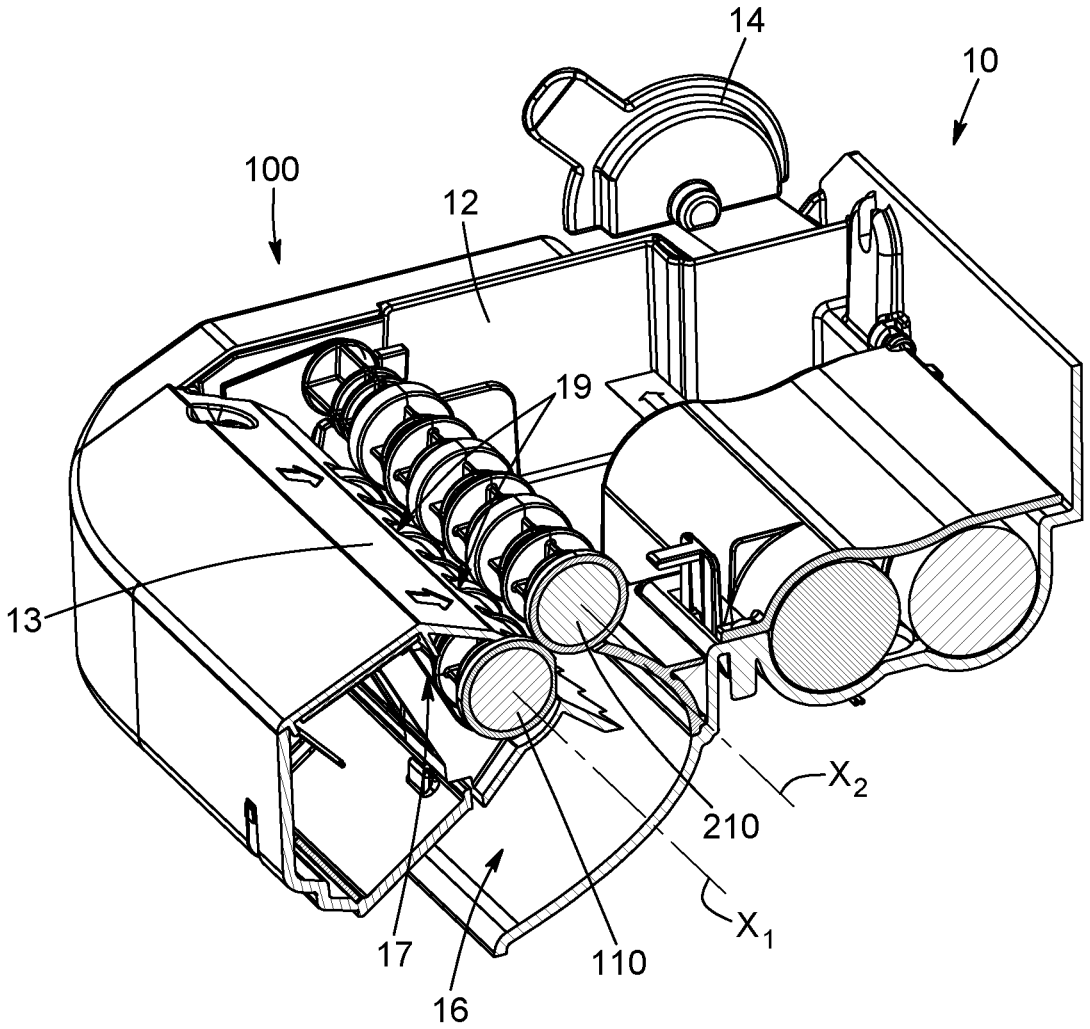
FIG. 2 is perspective sectioned view of the lower section of the web material dispenser of FIG. 1.

Referring now to the drawings, and more particularly to FIGS. 1 and 2, a lower section of a web material dispenser 10 is shown. In this specific example, the web material dispenser 10 is a dispenser for a paper tissue roll, but the disclosures also apply to a dispenser for a continuous paper tissue or for any web material arranged, without being limitative, in a continuous folded stack. In this specific example, the web material dispenser 10 is an electric or electronic hand towel dispenser, but the disclosures apply to manual or mechanical web material dispensers as well. The web material dispenser 10 comprises a housing 12 (or enclosure) defining an interior chamber. The web material dispenser 10 also includes a roll support assembly 14, configured to support a web material roll (not represented).

The web material dispenser 10 also includes a web material feed assembly 100 that is configured to cause the web material dispenser 10 to dispense an amount of web material (or tissue paper) for use by a user.

The web material dispenser 10 further includes a dispenser opening 16 (or mouth, or web material dispensing opening) formed in the housing 12 through which the web material is dispensed to the user. In the embodiment shown, the dispenser opening 16 is formed in a lower portion of the housing 12, but it can be located elsewhere.

In the embodiment shown, the web material dispenser 10 is of the electrically driven type and further comprises an electrical motor 18 configured to drive the web material feed assembly 100.

Web Material Feed Assembly

Figure 3:
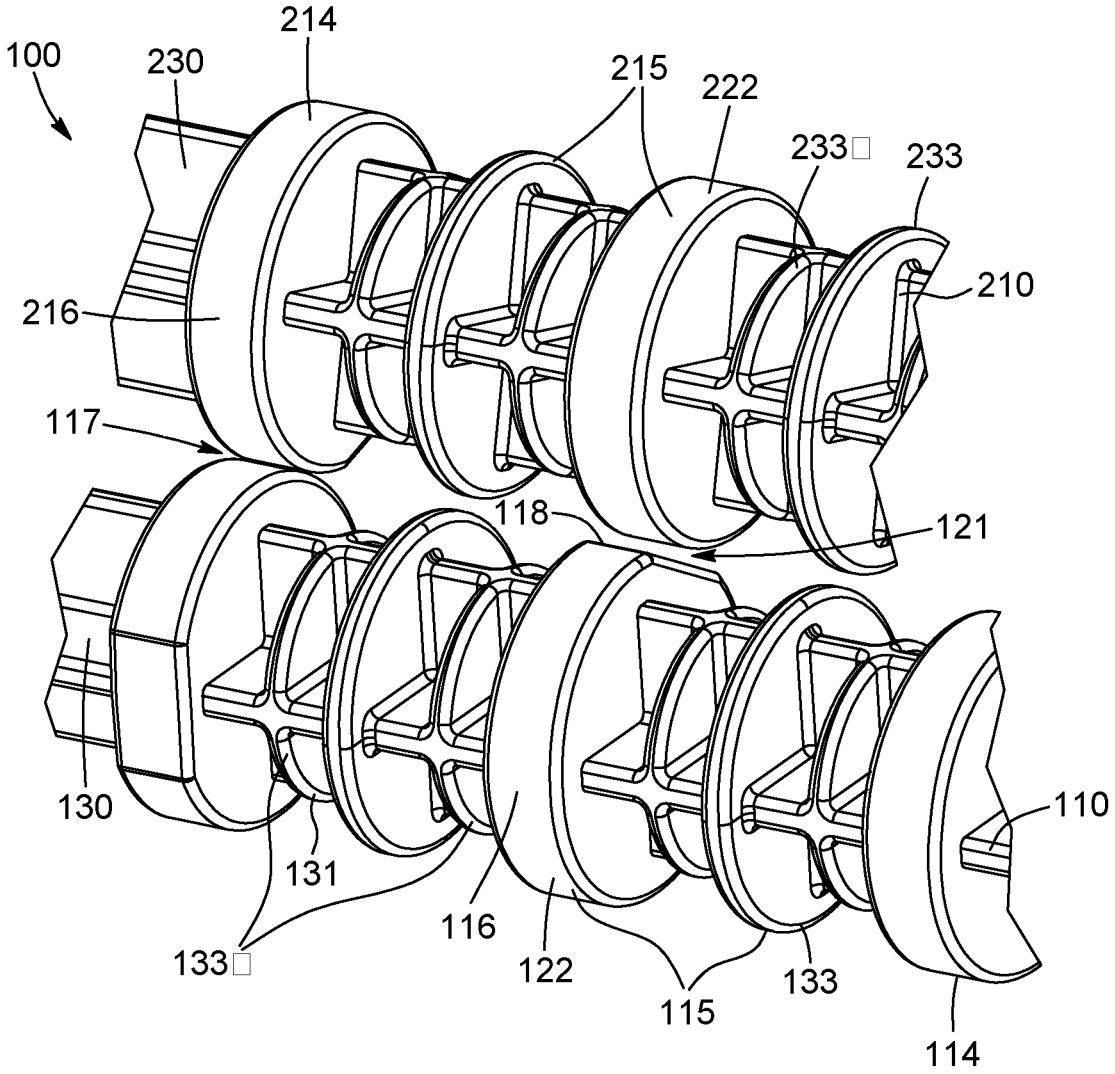
FIG. 3 is a top perspective view of a portion of first and second rollers of the web material feed assembly of the web material dispenser of FIG. 1.

Referring now particularly to FIGS. 1 to 3, the web material feed assembly 100 comprises a first roller 110 rotatably mounted relative to the housing 12 of the web material dispenser 10 about a first axis X1, and a second roller 210 rotatably mounted relative to the housing 12 about a second axis X2. In the embodiment shown, the first and second axes X1, X2, which can also be referred as first and second rotational axes X1, X2 or first and second longitudinal axes X1, X2 of the first and second rollers 110, 210, extend substantially parallel. The first and second rollers 110, 210 are configured to make the web material circulate in the housing 12 towards the dispenser opening 16 of the web material dispenser 10.

The first and second rollers 110, 210 have each an outer surface 115, 215 (or peripheral outer surface 115, 215 or circumferential outline 115, 215 or peripheral profile 115, 215). The peripheral outer surfaces 115, 215—or regions/faces surrounding or outwardly—with respect to the respective first and second longitudinal axes X1, X2—delimiting the rollers—are at least partially in contact with each other; the first and second rollers 110, 210 are arranged so that a nip 117 is defined between the first and second rollers 110, 210, and more specifically between at least a longitudinal segment—considered along the respective first and second axes X1, X2—of their outer surfaces 115, 215. In other words, the first and second rollers 110, 210 face each other, when mounted to the web material dispenser 10, face each other along longitudinal segments (or axial portions) of the first and second rollers 110, 210. Each of the longitudinal segments of the first and second rollers 110, 210 has a strip about a circumference thereof, the strips of facing longitudinal segments of the first and second rollers 110, 210 being at least partially in contact with each other upon rotation of the first and second rollers 110, 210, for feeding the web material in the housing 12 of the web material dispenser 10.

The nip 117 is a zone (or guiding zone) defined by facing and contacting outer surfaces of the first and second rollers 110, 210 for a portion of the web material to be sandwiched therebetween. The web material is thus dragged or pulled toward the dispenser opening 16. In the embodiment shown, the first and second rollers 110, 210 are biased towards each other (for instance via one or more springs or any other biasing members arranged, for instance, between the first and/or second rollers 110, 210 and the housing 12 of the web material dispenser 10).

In the following description, the term "circumference" should not be understood as being limited to rollers that would have a substantially circular cross-section (i.e. rollers that would be substantially cylindrical in shape, at least along a longitudinal segment thereof), but refers more generally to the external boundary or outer surface of the rollers.

In the embodiment shown, the first roller 110 is arranged closer to the dispenser opening 16 than the second roller 210. In other words, in the shown embodiment in which the dispenser opening 16 is formed in the lower portion of the housing 12, the first roller 110 extends lower than the second roller 210 in the housing 12 of the web material dispenser 10. Thus, in the embodiment shown, the first and second rollers 110, 210 may alternatively be designated by the terms lower and upper rollers. In the embodiment shown, and as it will be described below, as represented in FIG. 1, the first roller 110 is partially covered by a portion of the housing 12.

In the embodiment shown, the first roller 110 is coupled to the electric motor 18. The motor 18 causes the first roller 110 to rotate about the first axis X1. The first roller 110 may thus also be called a drive roller or a driving roller. The second roller 210, which is driven by the rotation of the first roller, thanks to the friction caused by the web material passing through the nip 117, may thus be called a pressure roller, a driven roller or a pinch roller. The second roller 210 is pressed against the first roller 110—or driven by the first roller 110—so that, when the first roller 110 is rotated by the motor 18 about the first axis X1, the web material is dispensed, as it is pressed against the first roller 110 by the second—or pressure—roller 210. It is understood that the function of the first and second rollers 110, 210 could be interchanged. For example, the second roller 210 could be coupled to the motor 18. In manual dispensers, a user would manually rotate one of the rollers, via a handle or push bar. In some embodiments, both rollers could be motorized. The first and second rollers 110, 210 may also be manually rotated about the first and second axes X1, X2 by a pulling force exerted by a user on the free/trail end of the web material protruding out of the dispenser opening 16 of the housing 12.

First Roller

Figure 4:
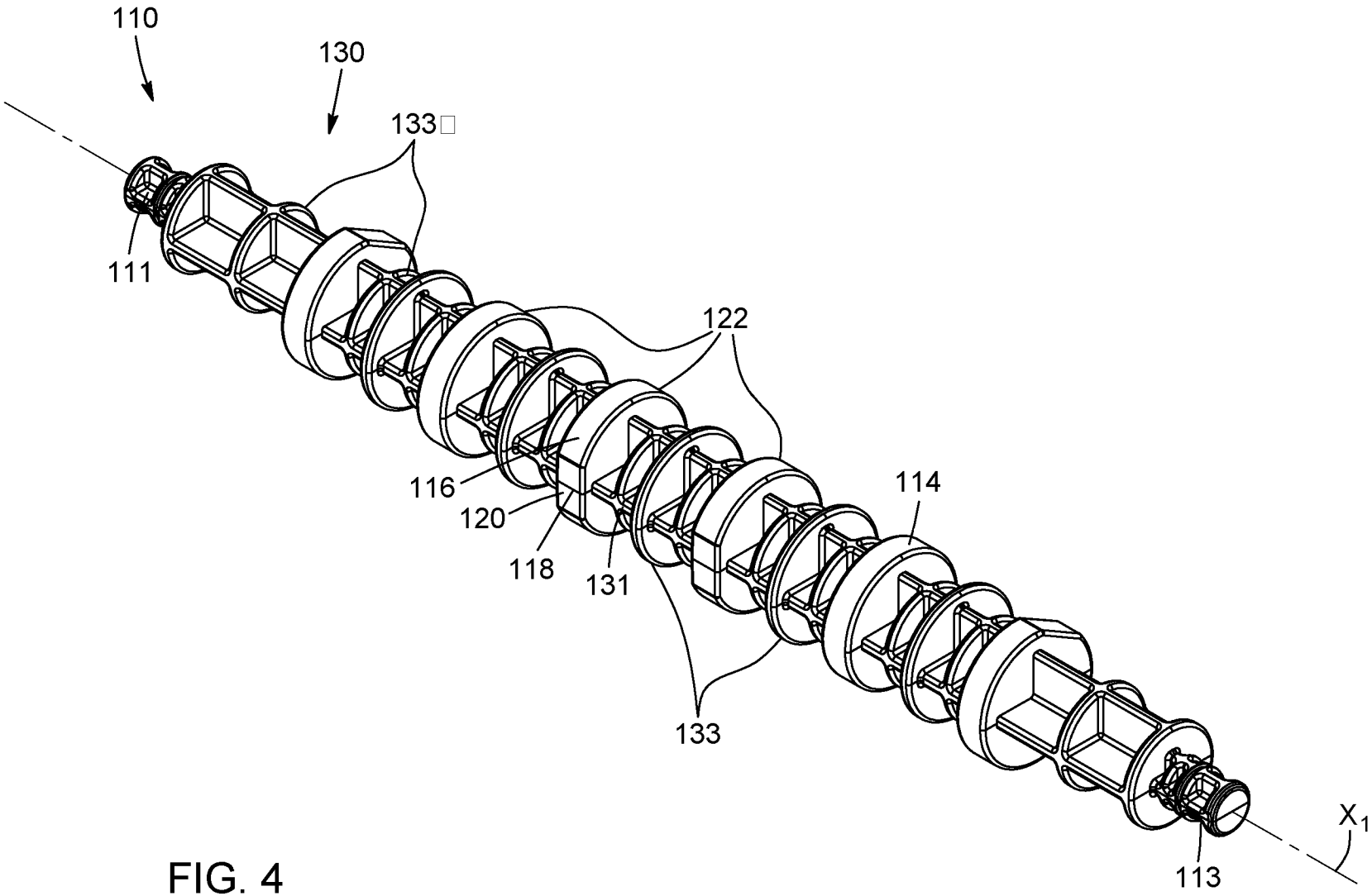
FIG. 4 is a perspective view of the first roller of the web material feed assembly of FIG. 3.
Figure 5:
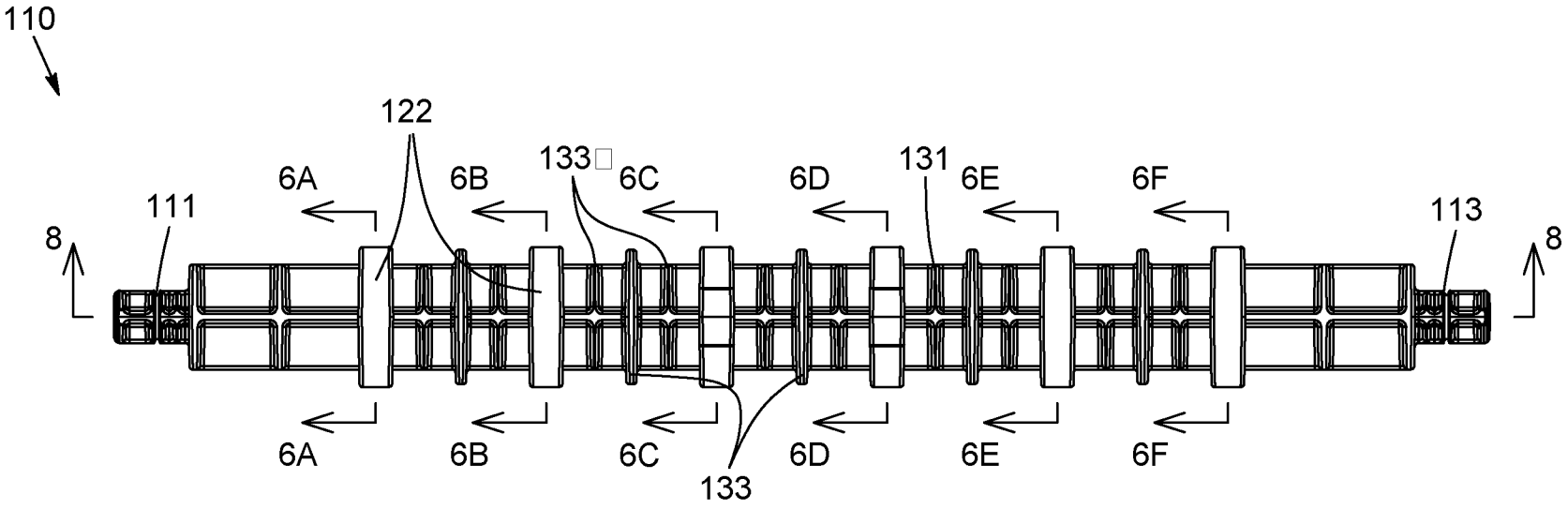
FIG. 5 is a side elevation view of the first roller of FIG. 4.
Figures 6A, 6B, 6C, 6D, 6E, 6F:
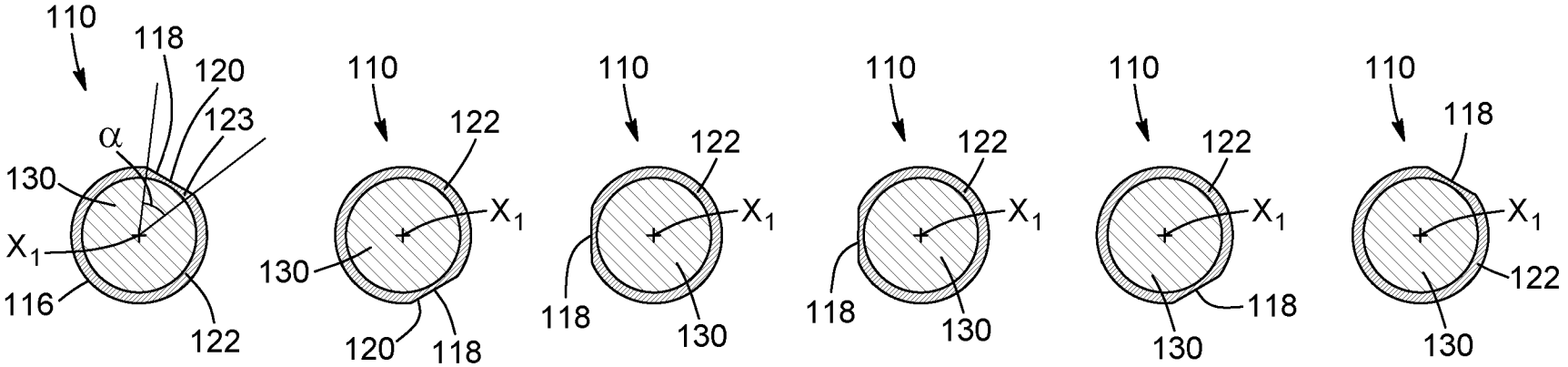
FIG. 6A is a cross-sectional view, taken along lines 6A-6A of FIG. 5, of a first friction ring of the first roller of FIG. 4, in a plane substantially perpendicular to a longitudinal axis of the first roller.
FIG. 6B is a cross-sectional view, taken along lines 6B-6B of FIG. 5, of a second friction ring of the first roller of FIG. 4, in a plane substantially perpendicular to a longitudinal axis of the first roller.
FIG. 6C is a cross-sectional view, taken along lines 6C-6C of FIG. 5, of a third friction ring of the first roller of FIG. 4, in a plane substantially perpendicular to a longitudinal axis of the first roller.
FIG. 6D is a cross-sectional view, taken along lines 6D-6D of FIG. 5, of a fourth friction ring of the first roller of FIG. 4, in a plane substantially perpendicular to a longitudinal axis of the first roller.
FIG. 6E is a cross-sectional view, taken along lines 6E-6E of FIG. 5, of a fifth friction ring of the first roller of FIG. 4, in a plane substantially perpendicular to a longitudinal axis of the first roller.
FIG. 6F is a cross-sectional view, taken along lines 6F-6F of FIG. 5, of a sixth friction ring of the first roller of FIG. 4, in a plane substantially perpendicular to a longitudinal axis of the first roller.

As best shown in FIGS. 4 and 5, the first roller 110 comprises a hub or core or roller core 130. In the embodiment shown, the hub 130 is made of a single element and is at least partially formed by molded polyoxymethylene (POM) in a single injection step, but other configurations, shapes and materials can be used.

Figure 8:
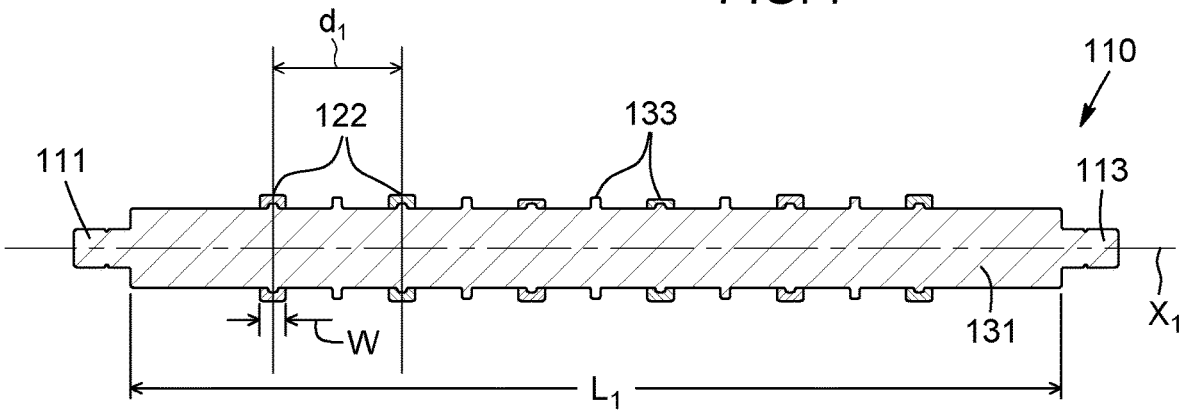
FIG. 8 is a cross-sectional view of the first roller of FIG. 4 in a plane comprising the longitudinal axis of the first roller.

The hub 130 of the first roller 110 comprises first and second longitudinally opposed mounting ends 111, 113, considered along the first axis X1. The first and second mounting ends 111, 113 are configured to cooperate with the housing 12, to rotatably mount the first roller 110 relative to the housing 12. It is understood that the first roller 110 can either be mounted directly to a wall portion of the housing 12, or indirectly, via other components of the web material dispenser 10. The hub 130 further comprises a central section 131 extending between the first and second mounting ends 111, 113 and having a length L1, as represented in FIG. 8. In the following description, the length L1 of the central section 131 will also be referred to as the length of the first roller 110.

Figure 7:
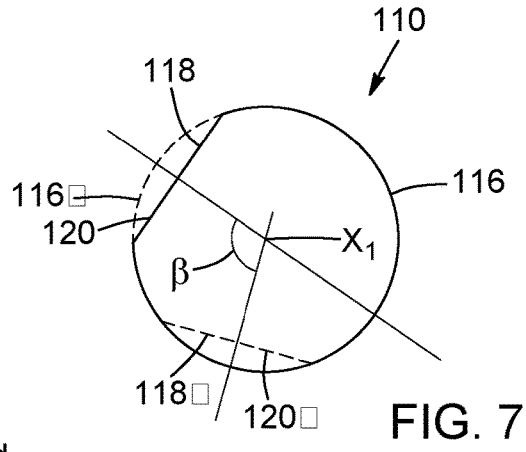
FIG. 7 is a schematic cross-sectional view of two successive superimposed friction rings in a plane substantially perpendicular to the longitudinal axis of the first roller.

In the embodiment shown, the central section 131 of the hub 130 has a body, which preferably has a rotational symmetry. In this example, the cross-section of the body, considered in a plane substantially perpendicular to the first axis X1, is "X-shaped" with a plurality of stiffening disks 133, 133' spaced-apart from one another along the length L1 of the central section 131. As represented in FIGS. 4 and 7, some of the stiffening disks 133 protrude outwardly beyond the X-shaped body of the hub 130 whereas some other stiffening disks 133' have a diameter corresponding substantially to a cross-section of the X-shaped body of the hub 130, considered in a plane substantially perpendicular to the first rotational axis X1. It is appreciated that the shape of the hub 130 of the first roller 110, the shape of the body of the hub 130 and the shape, number and arrangement of the stiffening disks 133, 133' can vary from the embodiment shown.

In the embodiment shown, the housing 12 of the web material dispenser 10 comprises a lower hood 13 defining a roller-receiving cavity 17. Disk-receiving apertures 19 are formed in the lower hood 13. The lower hood 13 substantially covers the first roller 110 contained at least partially in the roller-receiving cavity 17. At least some of the stiffening disks 133' protrude outwardly from the roller-receiving cavity 17 via the disk-receiving apertures 19.

The first roller 110 further comprises a plurality of friction rings 122 mounted to an outer surface of the hub 130 in a spaced-apart relationship. In the embodiment shown, the friction rings 122 extend axially relative to the first axis X1 of the first roller 110, and are preferably coaxial to the first axis X1. In the embodiment shown, an axis of each of the friction rings 122 is substantially parallel to the first axis X1, for instance is coaxial with the first axis X1. The friction rings 122 are preferably regularly spaced apart from each other. In the embodiment shown, the first roller 110 comprises six friction rings 122. Consecutive friction rings 122 are spaced apart from a separation distance d1, considered along the first axis X1. In some embodiments, the separation distance d1 between two consecutive friction rings 122 is smaller than 30% of the length L1 of the central section 131 of the first roller 110. In some other embodiments, the separation distance d1 is smaller than about 20% of the length L1. In some other embodiments, the separation distance d1 is smaller than 15% of the length L1. In yet some other embodiments, the separation distance d1 is about 14% of the length L1.

In this example, the friction rings 122 all have a similar shape, so that the following description of one of the friction rings 122 applies to any of them.

The friction ring 122 is preferably made of a material having a high coefficient of friction with the web material, which is typically cellulose-based, such as paper. The friction rings 122 can be made or include thermoplastic elastomers (TPE), rubber or any other similar material. The friction rings 122 can be inserted on the hub 130 or molded over the hub 130. The friction ring 122 can be called rubber rings or rubber tires, although they are not necessarily made of rubber. In the embodiment shown, the friction ring 122 extends over the periphery of some of the stiffening disks 133.

As represented in FIG. 8, the friction ring 122 has a width W, taken along the first axis X1. In the embodiment shown, the width W is comprised between about 1% and about 5% of the length L1 of the first roller 110. In the embodiment shown, the width W is comprised between about 10% and about 30% of the separation distance d1 between two consecutive friction rings 122.

As represented in FIGS. 3 and 4, the friction ring 122 has an outer surface 114 (or strip 114 or peripheral strip 114 or circumferential surface 114) comprising a guiding area or guiding region or guiding surface 116 and at least one anti-wrinkling area or anti-wrinkling region or anti-wrinkling surface or recessed surface 118. It thus understood that the friction ring 122 forms a longitudinal segment or axial portion of the first roller 110, the friction ring 122 having a strip about a circumference thereof forming a longitudinal segment of the outer surface 115 of the first roller 110. Outer surfaces of the stiffening disks 133 also form axial portions of the outer surface 115 of the first roller 110.

In the embodiment shown, and as detailed below, considered along the first axis X1, a cross-section of the friction ring 122 has a substantially constant area.

In the embodiment shown, the guiding area 116 is substantially circular, and has an arc shaped cross section considered in a plane substantially perpendicular to the first axis X1. The guiding area 116 is the angular portion of the outer surface or strip 114 of the friction ring 122 which contacts and pulls the web material, in conjunction with a friction ring from the second roller 210, facing the friction ring 122 of the first roller 110.

The anti-wrinkling area 118 is an angular portion of the outer surface 114 or strip of the friction ring 122 which is recessed, indented or set back relative to the guiding surface 116. In this example, the anti-wrinkling area 118 has a planar—or flat—cross section, considered perpendicularly to the first axis X1. In other words, the anti-wrinkling area 118 comprises a flat face 120. In yet other words, the friction ring 122 has a substantially cylindrical shape, the cylinder being partially sectioned along a plane substantially parallel to the axis of the friction ring 122 (i.e. substantially parallel to the first axis X1, in the embodiment in which the friction ring 122 is coaxial with the first axis X1). The planar—or flat—cross section of the anti-wrinkling area 118 defines a plane extending parallel to the first axis X1. In the embodiment shown, the anti-wrinkling area 118 delimits a circular segment a of the peripheral outer surface 114 of the friction ring 122 comprised between about 10 degrees and about 50 degrees. In some embodiments, the circular segment a is comprised between 25 degrees and about 35 degrees. In the embodiment shown, the different friction rings 122 have a substantially similar flat face 120 (i.e. delimit a substantially similar circular segment). It could also be conceived friction rings 122 having different flat faces 120.

Figure 9:
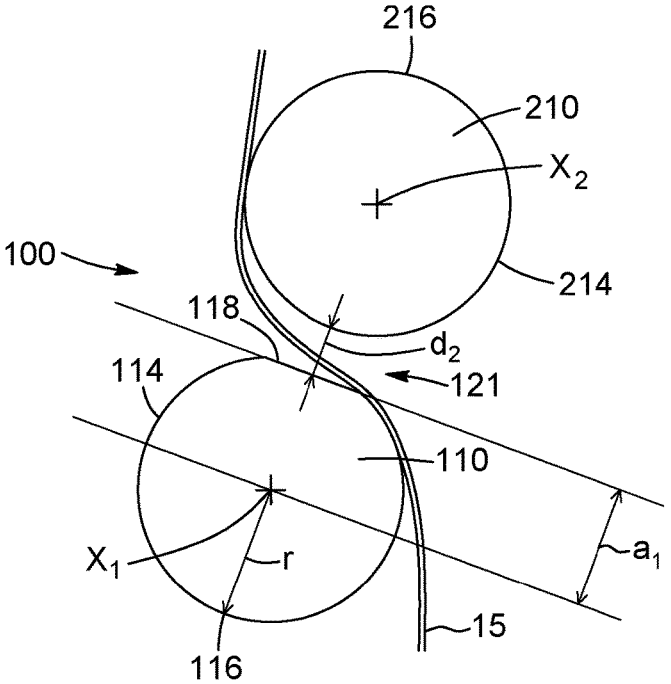
FIG. 9 is a schematic cross-sectional view of the portion of the web material feed assembly of FIG. 3

The anti-wrinkling area 118 defines an anti-wrinkling distance al corresponding to the smallest distance of the flat face 120 to the first rotational axis X1, as represented in FIG. 9. The anti-wrinkling distance al is smaller than a guiding distance r of the guiding area 116 to the first rotational axis X1 (i.e. smaller than a radius of a circle defined by the guiding area 116 in a plane substantially parallel to the first rotational axis X1). In some embodiments, the anti-wrinkling distance al is smaller than about 97% of the guiding distance or friction ring radius r. In some other embodiments, the anti-wrinkling distance al is smaller than about 95% of the guiding distance or friction ring radius r. In some other embodiments, the anti-wrinkling distance al is smaller than about 90% of the guiding distance or friction ring radius r. In some embodiments, the anti-wrinkling distance al is about 92% of the friction ring radius r.

As represented in FIGS. 6A to 6F and in FIG. 7, the recessed surface 118 of a given one of the friction rings 122 is angularly offset by an angle greater than zero degree relative to the recessed surface of an adjacent one of the friction rings 122. In other words, the anti-wrinkling areas 118, 118' of two consecutive friction rings 122 are angularly—or circumferentially—offset relative to each other by an angular offset angle β greater than zero degree. Of course, the size and shape of the recesses can differ from what is shown in FIG. 7—the recessed/flat areas have been enlarged to better illustrate offset the anti-wrinkling areas from one anti-friction ring to the next.

In the embodiment shown, the first roller 110 defines a plane of symmetry substantially perpendicular to the first axis X1. The first roller 110 thus comprises two central friction rings 122 (represented in FIGS. 6C and 6D), the recessed surfaces 118 of the two central friction rings 122 being in register (i.e. define an angular offset angle β of about zero degree).

In some embodiments, the angular offset angle β between the anti-wrinkling areas 118, 118' of two consecutive friction rings 122 is comprised between about 50 degrees and about 190 degrees. In some other embodiments, the angular offset angle β between the anti-wrinkling areas 118, 118' of two consecutive friction rings 122 is comprised between about 70 degrees and about 170 degrees. In some other embodiments, the angular offset angle β between the anti-wrinkling areas 118, 118' of two consecutive friction rings 122 is comprised between about 90 degrees and about 150 degrees. In yet some other embodiment, the angular offset angle β between the anti-wrinkling areas 118, 118' of two consecutive friction rings 122 is about 120 degrees.

It is appreciated that the shape, the dimensions and the number of the anti-wrinkling areas 118 of each friction ring 122 can vary from the embodiment shown. In particular, the wrinkling area 118 may comprise, in place of or in addition with the flat face 120, a concave surface or any other surface forming a recessed or indented surface in the friction ring 122. The friction ring 122 may also comprise more than one wrinkling area 118 formed on the peripheral outer surface 114, having similar or different shapes and dimensions from each other.

It is further appreciated that the shape, the configuration and the location of the friction rings 122 can vary from the embodiment shown. The first roller 110 may also be designed or formed without including any distinct friction rings 122. In this case, the guiding areas 116 and the anti-wrinkling areas 118 would be directly formed on an outer surface of the central section 131 of the hub 130. For instance, it could be conceived a first roller 110 having a substantially cylindrical shape, an anti-wrinkling slot being formed in the outer surface of the first roller 110. For instance, the anti-wrinkling slot or groove could extend in a direction substantially parallel to the first axis X1 or could have a substantially helical shape surrounding the first axis X1.

Second Roller

With reference to FIGS. 1 to 3, the second roller 210 has a substantially similar structure to the first roller 110. The second roller 210 thus comprises a hub (or core) 230 comprising first and second longitudinally opposed mounting ends 211, 213, considered along the second rotational axis X2, that are configured to cooperate with the housing 12 so as to rotatably mount the second roller 210 relative to the housing 12. It is understood that the second roller 210 can either be mounted directly to a wall portion of the housing 12, or indirectly.

Similarly to the first roller 110 described above, in the embodiment shown, the hub 230 of the second roller 210 is made of a single element and is at least partially formed by molded polyoxymethylene (POM) in a single injection step, but other configurations, shapes and materials can be used. For instance and without being limitative, the shape and structure of the hub 230 of the second roller 210 are substantially similar to the shape and structure of the hub 130 of the first roller 110.

The hub 230 has a central section 231. The second roller 210 further comprises a plurality of friction rings 222 mounted to an outer surface of the hub 230 and being axially aligned with respect to the friction rings 122 of the first roller 110 when the first and second rollers 110, 210 are mounted to the web material dispenser 10 so that the friction rings 112, 222 of the first and second rollers 110, 210 form facing longitudinal segments of the first and second rollers 110, 210.

Similarly to the friction rings 122 of the first roller 110, the friction rings 222 of the second roller 210 are preferably made of a material having a high coefficient of friction with the web material. The friction rings 222 can be made or include thermoplastic elastomers (TPE), rubber or any other similar material. The friction rings 222 can be inserted on the hub 230 or molded over the hub 230. The friction rings 222 can be called rubber rings or rubber tires, although they are not necessarily made of rubber. In the embodiment shown, the friction ring 222 extends over the periphery of some of the stiffening disks 233, 233' of the hub 230.

In the embodiment shown, as represented in particular in FIG. 3, the friction rings 222 have a substantially cylindrical shape and have a circular cross-section, considered perpendicularly to the second axis X2, along an entire outer surface 214. In other words, the friction rings 222 of the second roller 210 have, in the embodiment shown, a substantially circular circumference. It is thus understood that the peripheral surface 214 of the friction rings 222 forms axial portions of the outer surface 215 of the second roller 210. In other words, in the embodiment shown, the friction rings 222 of the second roller 210 do not include any recessed or indented area(s). The friction rings 222 are entirely circular and their outer surface 214 forms a continuous guiding area 216 to drag the web material with the friction ring 122 of the first roller 110 facing it. In the embodiment shown, a guiding distance of the guiding area 216 of the friction ring 222 to the second axis X1 substantially corresponds to the guiding distance or friction ring radius r of the guiding area 116 of the friction ring 122 of the first roller 110 to the first axis X1. It could however be conceived first and second rollers 110, 210 having different dimensions (for instance a second roller with a guiding area having a guiding distance greater or smaller than a guiding distance of a guiding area of a first roller). In the embodiment shown, as represented in FIG. 1, the second roller 210 comprises six friction rings 222 regularly spaced apart along the hub 230, corresponding in pairs to the six friction rings 122 of the first roller 110. Consecutive friction rings 222 are spaced-apart from a separation distance corresponding substantially to the separation distance d1 between consecutive friction rings 122 of the first roller 110. Moreover, in the embodiment shown, the friction rings 222 of the second roller 210 have a width corresponding substantially to the width W of the friction rings 122 of the first roller 110.

That said, in other embodiments, the friction rings 222 of the second roller 210 could be substantially similar to the friction rings 122 of the first roller 110, in that they may include recessed regions as well. In other words, it could be possible for the second roller 210 to be provided with friction rings 222 comprising a guiding area, having for instance an arc-shaped cross section, and at least one anti-wrinkling area (or recessed anti-wrinkling area), having for instance a planar—or flat—cross section, forming a recessed surface of the friction ring 222. In some embodiments, the first and second rollers 110, 210 could be arranged so that the anti-wrinkling areas of two facing friction rings 122, 222 would not be facing one another at the same time, when rotating. In other words, in these embodiments, positioning of the first and second rollers 110, 210 in the dispenser would be such that the anti-wrinkling areas of the first and second rollers would face respectively a circumferential portion of the guiding areas of the second and first rollers. In yet other words, the anti-wrinkling areas of the first and second rollers 110, 210 would not be in register with one another.

In some embodiments, the second roller 210 can include a plurality of friction rings 222, which may be regularly axially spaced apart along the hub 230 of the second roller 210. Similar to the first roller, in the embodiments in which the friction rings 222 of the second roller 210 would comprise anti-wrinkling areas, the anti-wrinkling areas of two consecutive friction rings could be angularly offset relative to each other.

Feeding of the Web Material in the Web Material Feed Assembly

The first and second rollers 110, 210 of the web material feed assembly 100 are arranged to cooperate with the web material to make it circulate towards the dispenser opening 16 of the web material dispenser 10, while preventing or limiting the risk for the web material to be wrinkled.

In the embodiment shown, the friction rings 122, 222 of the first and second rollers 110, 210 are arranged for their outer peripheral surface 114, 214 to face each other. In other words, the friction rings 122, 222 of the rollers 110, 210 are facing one another in pairs. In yet other words, the friction rings 122, 222 of the first and second rollers 110, 210 are axially aligned with each other.

The first and second rollers 110, 210 comprise facing peripheral outer surfaces 115, 215 (i.e. facing axial portions of their respective outer peripheral surfaces 114, 214). In the embodiment shown, the guiding area 116 of the friction rings 122 of the first roller 110 is configured to contact the peripheral outer surface 214 of the second roller 210 (the peripheral outer surface 214 of the friction rings 222 thereof, in the embodiment shown) so as form the above-mentioned nip 117 therebetween in which the web material is fed. In other words, the first and second rollers 110, 210 have portions of their peripheral outer surfaces 115, 215 in contact with each other to form the nip 117 therebetween for feeding the web material. It is thus understood that the nip 117 is formed by a contact region defined between the first and second rollers 110, 210. In other words, the nip 117 is configured and dimensioned to squeeze the web material between portions of the peripheral outer surfaces 115, 215 of the first and second rollers 110, 210. In yet other words, the first and second rollers 110, 210 are biased toward each other so that when the web material passes through the nip 117, the rotation of the first and second rollers 110, 210 dispenses the web material outside the housing 12 through the dispenser opening 18.

Said differently, the first and second rollers 110, 210 are configured so that, when in use, the first roller 110 is rotatable about the first longitudinal axis X1 along a first angular interval wherein the guiding area 116 contacts the facing friction ring 222 of the second roller 210 (or a portion of the outer surface thereof) so as to form the nip 117 therebetween through which the web material is fed.

It is understood that the first and second rollers 110, 210 are arranged so that the nip 117 formed between their respective peripheral outer surfaces 115, 215 (or at least between facing axial portions thereof or between facing friction rings 122, 222) is dimensioned to receive the web material, while the rotation of the first and second rollers 110, 210 about their respective first and second axes X1, X2 ensures the circulation or advancement of the web material in the housing 12 of the web material dispenser 10. For instance, the axial portions of the peripheral outer surfaces 115, 215 of the first and second rollers 110, 210, formed in the embodiment shown by the outer surfaces or outer strips 114, 214 of the friction rings 122, 222, might be formed in a material having friction and elastic properties ensuring an efficient circulation of the web material without tearing it.

In the embodiment shown, the guiding area 116 of the friction rings 122 is configured to contact the outer peripheral surface 214 of the facing friction rings 222, the nip 117 being formed between the guiding area 116 of the friction rings 122 of the first roller 110 and the outer peripheral surface 214 of the second roller 210 (i.e. between axial portions of the peripheral outer surfaces 115, 215 of the first and second rollers 110, 210). It could also be conceived a second roller 210 having simply a hub 230 comprising a central section 231 without any friction rings mounted thereto, the friction rings 122 of the first roller 110 cooperating directly with a peripheral outer surface of the central section 231 of the second roller 210.

Moreover, the anti-wrinkling areas 118 of the friction rings 122 of the first roller 110 are configured to be spaced apart from the facing axial portion of the peripheral outer surface 215 of the second roller 210 so as to form anti-wrinkling spaces 121 therebetween. In other words, the anti-wrinkling spaces 121 defined between the first and second rollers 110, 210 are formed by the anti-wrinkling recessed areas formed in the peripheral outer surface 115 of the first roller 110. In other words, the first and second rollers 110, 210 are configured so that, when in use, the first roller 110 is rotatable about the first longitudinal axis X1 along a second angular interval wherein the anti-wrinkling area 118 is spaced apart from the facing friction ring 222 of the second roller 210, forming an anti-wrinkling space therebetween.

It should be understood that the above-mentioned first and second angular intervals are determined by the dimensions of the guiding area 116 and the anti-wrinkling area 118 of the friction rings 122 of the first roller 110. For instance, the first angular interval is comprised between about 300 degrees and about 350 degrees. In some other embodiments, the first angular interval is comprised between about 310 degrees and about 340 degrees. In some embodiments, the second angular interval is comprised between about 10 degrees and about 50 degrees.

In the embodiment shown, the anti-wrinkling areas 118 of the friction rings 122 of the first roller 110 are configured to be spaced apart from the outer peripheral surface 214—or strips 214 or circumferential surface 214—of the facing friction rings 222, the anti-wrinkling spaces 121 being delimited by the recessed surface of the anti-wrinkling areas 118 and the outer peripheral surface 214 of the friction rings 222 of the second roller 210. In other words, as represented in FIG. 9, the distance d2 between the outer peripheral surfaces 114, 214 of the friction rings 122, 222 at the anti-wrinkling areas 118 of the first roller 110 is greater than the thickness of the web material. In some embodiments, the distance d2 is of the order of at least four times the thickness of the web material. In some other embodiments, the distance d2 is of the order of at least eight times the thickness of the web material. In yet some other embodiments, the distance d2 is of the order of at least twelve times the thickness of the web material.

It is to be noted that the width W of the friction rings 122 of the first roller 110—and of the corresponding friction rings 222 of the second roller 210 if any—is chosen to be large or wide enough to ensure an efficient circulation of the web material in the nip 117 formed between the first and second rollers 110, 210 without leaving marks on the web material, and to be narrow enough to limit the risk of wrinkling the web material.

It is thus understood that when the first roller 110 is rotated about the first axis X1, nips and anti-wrinkling spaces are successively formed between the first and second rollers 110, 210.

The formation of the nips 117 allows the circulation of the web material in the web material dispenser 10, the web material being maintained between facing axial portions of the first and second rollers 110, 210. In other words, the friction rings 122, 222 of the first and second rollers 110, 210 are in close relation with each other so that the web material is sandwiched between facing axial portions of the peripheral outer surfaces 115, 215 of the first and second rollers 110, 210. The rotation of the first and second rollers 110, 210 respectively about their first and second axes X1, X2 makes the web material circulate towards the dispenser opening 16.

On the other hand, and as best shown in FIG. 9, the formation of the anti-wrinkling spaces 121 between the first and second rollers 110, 210 limits the wrinkling of the web material 15. In particular, in case wrinkles are formed or about to be formed on the web material, the formation of anti-wrinkling spaces 121 makes it possible for the web material to be "stress-relieved". In other words, the anti-wrinkling spaces 121 defined between the first and second rollers 110, 210 allow the portion of the web material 15 to fully extend (deploy) between the first and second rollers 110, 210, and thus to retrieve a flat state. Again here, the size and shape of the indented/recessed portions on the friction rings 122 can vary from what is illustrated. FIG. 9 aims to depict the increased space in the nip, resulting from the recessed portions in the friction rings 122, that allows creases or accumulation of the web material between the first and second rollers 110, 210 to pass through, thereby limiting or reducing wrinkling of the web of material.

The succession on the peripheral outer surface 114 of the friction ring 122 of the guiding area 116 and the anti-wrinkling area 118 makes it possible to regularly remove the wrinkles—or regularly prevent the formation of wrinkles—without jeopardizing the circulation of the web material.

The presence of axially spaced apart friction rings 122 along the first roller 110, with angularly offset anti-wrinkling areas 118, ensures that at least one nip 117 is always formed between two facing axial portions of the first and second rollers 110, 210, no matter the angular position of the first and second rollers 110, 210. In other words, it is understood that the anti-wrinkling areas 118, thanks to which the wrinkling of the web material is limited, do not compromise the cooperation of the web material with the first and second rollers 110, 210 of the web material feed assembly 100, and thus do not compromise the dispensing of the web material by the web material dispenser 10.

It is understood that the anti-wrinkling spaces 121 formed between the first and second rollers 110, 210 by the anti-wrinkling areas 118, helps in providing a flat sheet of web material to the user.

The anti-wrinkling spaces 121 also limit the risk for the web material to "walk" from a side of the housing 12 to another, such a walking usually occurring due to the wrinkling of the web material.

In the embodiment in which the web material dispenser 10 comprises an electrical motor 18 to drive at least one of the first and second rollers 110, 210, the anti-wrinkling spaces 121 further limit the risk of web material jamming, the web material being pushed by the first and second rollers 110, 210 towards the dispenser opening 16.

It is to be noted that the first and second rollers 110, 210 might also be rotated about the first and second axes X1, X2 in a reverse direction with regards to the forward dispensing direction, for instance to limit the length of the free end of the web material protruding out of the housing 12.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

The invention claimed is:

1. A web material feed assembly for a web material dispenser comprising a housing, the web material feed assembly comprising:

a first roller rotatably mountable to the housing of the web material dispenser, about a first longitudinal axis;

a second roller rotatably mountable to the housing of the web material dispenser, about a second longitudinal axis parallel to the first longitudinal axis;

the first and second rollers having respective first and second lengths and facing one another along at least one longitudinal segment thereof when the first and second rollers are mounted to the housing of the web material dispenser, wherein said at least one longitudinal segment of the first roller has a strip about a circumference thereof comprising at least one guiding area and at least one anti-wrinkling area, wherein, when in use, the first roller is successively rotatable about the first longitudinal axis along:

a first angular interval wherein said at least one guiding area contacts said at least one longitudinal segment of the second roller forming a nip therebetween through which a web material is fed; and a second angular interval wherein said at least one anti-wrinkling area is spaced apart from said at least one longitudinal segment of the second roller, forming an anti-wrinkling space therebetween.

2. The web material feed assembly according to claim 1, wherein, considered in plane substantially perpendicular to the first longitudinal axis, the at least one guiding area has an arc shaped cross section.

3. The web material feed assembly according to claim 1, wherein said at least one anti-wrinkling area comprises a flat face.

4. The web material feed assembly according to claim 1, wherein said at least one anti-wrinkling area defines an anti-wrinkling distance corresponding to the smallest distance of said at least one anti-wrinkling area to the first longitudinal axis, and wherein said at least one guiding area defines a guiding distance corresponding to the smallest distance of said at least one guiding area to the first longitudinal axis, the anti-wrinkling distance and the guiding distance being both considered in a plane substantially perpendicular to the first longitudinal axis, wherein the anti-wrinkling distance is smaller than the guiding distance.

5. The web material feed assembly according to claim 1, wherein the first and second rollers face one another along a plurality of regularly spaced-apart longitudinal segments thereof, each of said plurality of longitudinal segments of the first roller having a strip about a circumference thereof comprising at least one guiding area and at least one anti-wrinkling area.

6. The web material feed assembly according to claim 5, wherein the anti-wrinkling areas of at least two consecutive longitudinal segments are circumferentially offset relative to each other.

7. The web material feed assembly according to claim 1, wherein said at least one longitudinal segment of the second roller comprises a strip about a circumference thereof comprising at least one guiding area and at least one anti-wrinkling area and wherein said at least one anti-wrinkling area of the first roller faces a portion of said at least one guiding area of the second roller and said at least one anti-wrinkling area of the second roller faces a portion of said at least one guiding area of the first roller when the first and second rollers are in use.

8. A web material feed assembly for a web material dispenser comprising a housing, the web material feed assembly comprising:

first and second rollers rotatably mountable relative to the housing of the web material dispenser about first and second parallel longitudinal axes, the first roller being provided with at least one friction ring facing at least one longitudinal segment of the second roller and having at least one guiding surface contacting an outer surface of said at least one longitudinal segment of the second roller and forming a nip between the first and second rollers for feeding a web material therethrough when the first and second rollers are in use;

wherein said at least one friction ring comprises at least one recessed surface forming an anti-wrinkling space between the first and second rollers.

9. The web material feed assembly according to claim 8, wherein said at least one recessed surface comprises a flat face.

10. The web material feed assembly according to claim 8, wherein said at least one recessed surface defines an anti-wrinkling distance corresponding to the smallest distance of said at least one recessed surface to the first longitudinal axis, and wherein said at least one guiding surface defines a guiding distance corresponding to the smallest distance of said at least one guiding surface to the first longitudinal axis, the anti-wrinkling distance and the guiding distance being both considered in a plane substantially perpendicular to the first longitudinal axis, wherein the anti-wrinkling distance is smaller than the guiding distance.

11. The web material feed assembly according to claim 8, wherein said at least one friction ring is at least partially made of TPE.

12. The web material feed assembly according to claim 8, wherein said first roller comprises a hub having an outer surface, said at least one friction ring being mounted to the outer surface of the hub.

13. The web material feed assembly according to claim 12, wherein the hub comprises at least one stiffening disk, said at least one friction ring extending over a periphery of said at least one stiffening disk.

14. The web material feed assembly according to claim 8, wherein the first roller is provided with a plurality of regularly spaced-apart friction rings, each of said plurality of friction rings having at least one guiding surface and at least one recessed surface.

15. The web material feed assembly according to claim 14, wherein the recessed surfaces of at least two consecutive friction rings are circumferentially offset relative to each other.

16. The web material feed assembly according to claim 8, wherein the second roller is provided with at least one friction ring facing said at least one friction ring of the first roller when the first and second rollers are mounted to the housing of the web material dispenser and wherein said at least one friction ring of the second roller comprises at least one guiding surface forming a nip between the first and second rollers and at least one recessed surface forming an anti-wrinkling space between the first and second rollers.

17. The web material feed assembly according to claim 16, wherein said at least one recessed surface of the first roller and said at least one recessed surface of the second roller are arranged so as to face respectively a portion of said at least one guiding area of the second roller and a portion of said at least one guiding area of the first roller.

18. A web material dispenser configured to dispense a web material, the web material dispenser comprising:

a housing; and a web material feed assembly according to claim 1, the first and second rollers of the web material feed assembly being rotatably mounted to the housing.

19. The web material dispenser according to claim 18, wherein the housing comprises a lower hood defining a roller-receiving cavity, the first roller of the web material feed assembly being at least partially received in the roller-receiving cavity and wherein at least one disk-receiving aperture is formed in the lower hood, a portion of the first roller protruding outwardly from the roller-receiving cavity through said at least one disk-receiving aperture.

20. A method for preventing wrinkles in a web material dispensed by a web material dispenser having a housing, a dispenser opening being formed in the housing, the method comprising the steps of:

providing first and second rollers rotatably mounted to the housing about first and second parallel longitudinal axes and forming a nip therebetween, each of the first and second rollers having an outer surface devised to contact each other at at least one longitudinal segment thereof, the outer surface of said at least one longitudinal segment of at least one of the first and second rollers comprising at least one recess forming an anti-wrinkling space between the first and second rollers;

circulating a portion of the web material in the nip by squeezing the web material between the outer surfaces of the longitudinal segments of the first and second rollers;

rotating at least one of the first and second rollers to drag the web material toward the dispenser opening; and allowing a portion of the web material to fully extend in the anti-wrinkling space so as to limit the wrinkling thereof.

21. The method according to claim 20, wherein the outer surfaces of the first and second rollers are devised to contact each other at a plurality of longitudinal segments thereof, the outer surface of said plurality of longitudinal segments of at least one of the first and second rollers comprising at least one recess, the recesses of at least two consecutive longitudinal segments being circumferentially offset, the method further comprising forming constantly at least one nip between two facing longitudinal segments of the first and second rollers while rotating said at least one of the first and second rollers.

* * * * *